US009211023B1

(12) United States Patent
Weiss

(10) Patent No.: US 9,211,023 B1
(45) Date of Patent: Dec. 15, 2015

(54) GARMENT HANGING SYSTEM

(71) Applicant: David P. Weiss, Carol Stream, IL (US)

(72) Inventor: David P. Weiss, Carol Stream, IL (US)

( * ) Notice: Subject to any disclaimer, the term of this patent is extended or adjusted under 35 U.S.C. 154(b) by 206 days.

(21) Appl. No.: 13/869,098

(22) Filed: Apr. 24, 2013

Related U.S. Application Data

(63) Continuation-in-part of application No. 13/083,781, filed on Apr. 11, 2011, now abandoned.

(51) Int. Cl.
*A47B 96/00* (2006.01)
*A47G 25/06* (2006.01)

(52) U.S. Cl.
CPC ..... *A47G 25/0614* (2013.01)

(58) Field of Classification Search
CPC ..... A47G 25/0614; A47G 25/0607; A47G 25/02; A47G 25/06; F16B 45/00; A47F 5/0006
USPC ..... 248/339, 340, 317, 304, 305, 306, 248/309.1, 225.21; 211/113, 106.01, 211/119.004; 2/67; 223/85, 120, 92, 93
See application file for complete search history.

(56) References Cited

U.S. PATENT DOCUMENTS

| | | | | |
|---|---|---|---|---|
| 318,657 | A | 5/1885 | Richards | |
| 330,497 | A | 11/1885 | Lash | |
| 1,216,730 | A | 2/1917 | Quiggle | |
| 1,447,636 | A | 3/1923 | White | |
| 1,652,571 | A | 12/1927 | Hassa | |
| 1,837,692 | A | 12/1931 | Thomas | |
| 2,360,089 | A | 10/1944 | Wigod | |
| D151,372 | S | 10/1948 | Keefer | |
| 2,508,527 | A | 5/1950 | Martin | |
| 2,514,790 | A | 7/1950 | Ostrow | |
| 2,671,706 | A | 3/1954 | Greengold | |
| 2,925,916 | A | 2/1960 | Pollock | |
| 2,972,419 | A | 2/1961 | Zelen | |
| 3,208,597 | A | 9/1965 | Hansen | |
| 3,342,343 | A | 9/1967 | Youlden | |
| 3,536,287 | A * | 10/1970 | Kramer | A47G 25/0614 248/215 |
| 3,907,118 | A | 9/1975 | Pelavin | |
| 4,123,024 | A | 10/1978 | Levy | |
| 4,146,138 | A * | 3/1979 | Davis | A47F 7/147 211/106 |
| 4,901,871 | A | 2/1990 | Ohm | |
| 5,065,915 | A | 11/1991 | Rosch | |
| 5,087,007 | A | 2/1992 | Gaderick | |
| D345,096 | S | 3/1994 | Shapiro | |
| 5,413,297 | A | 5/1995 | Adams | |
| 5,433,355 | A * | 7/1995 | Watkins | A47G 25/56 211/123 |
| 5,515,981 | A | 5/1996 | Gregory | |
| 5,645,178 | A | 7/1997 | Conley, Jr. | |
| 5,740,994 | A | 4/1998 | Laughlin | |
| 5,875,902 | A | 3/1999 | Emery | |
| 5,876,009 | A * | 3/1999 | Simoncioni, Jr. | A47G 25/1442 211/88.01 |

(Continued)

*Primary Examiner* — Todd M Epps
(74) *Attorney, Agent, or Firm* — Neustel Law Offices

(57) ABSTRACT

A garment hanging system for safely hanging a long garment from a structure such as a door without the garment coming into contact with the floor or the surface of the door. The garment hanging system generally includes a bracket, a mounting portion extending from a first end of the bracket and an extension member extending from a second end of the bracket. The mounting portion extends downwardly from the bracket and includes a hook for holding a garment or accessory. The extension member extends upwardly and diagonally from the bracket such that any garment stored on a hook thereof will not contact the ground. An adjustment member may be positioned within the bracket to alter its effective width to match a wide range of doors.

14 Claims, 5 Drawing Sheets

(56) References Cited

U.S. PATENT DOCUMENTS

| | | | | |
|---|---|---|---|---|
| 5,887,407 | A * | 3/1999 | Watkins | B65B 67/02 206/289 |
| 5,950,882 | A | 9/1999 | Scott | |
| 6,196,429 | B1 * | 3/2001 | Cavdek | A41H 5/00 223/120 |
| 6,267,257 | B1 | 7/2001 | DeBruyn | |
| 6,302,365 | B1 * | 10/2001 | Catanzarite | A47G 25/0614 248/215 |
| 6,311,851 | B1 | 11/2001 | Knudsen, Sr. | |
| 6,520,351 | B1 | 2/2003 | Zadro | |
| 6,854,610 | B2 | 2/2005 | Adams | |
| 7,185,864 | B2 | 3/2007 | Adams | |
| 7,207,088 | B2 | 4/2007 | Adams | |
| 7,252,274 | B1 * | 8/2007 | Brannen | A47J 45/02 248/301 |
| 7,520,476 | B2 | 4/2009 | Caveney | |
| 7,789,359 | B2 | 9/2010 | Chopp | |
| 7,887,017 | B2 | 2/2011 | Moran | |
| 7,992,833 | B1 * | 8/2011 | Goodman | A47G 25/0614 248/298.1 |
| D657,054 | S * | 4/2012 | Bacon | D24/128 |
| 8,251,342 | B1 * | 8/2012 | Weiner | A63C 17/0006 211/106.01 |
| 2003/0222040 | A1 | 12/2003 | Boysen | |
| 2004/0094494 | A1 | 5/2004 | Klein | |
| 2007/0062897 | A1 | 3/2007 | Lawrence | |
| 2009/0189037 | A1 | 7/2009 | Shortell | |
| 2010/0147788 | A1 | 6/2010 | Hendricks | |
| 2010/0224747 | A1 | 9/2010 | Adams | |

* cited by examiner

GARMENT HANGING SYSTEM

CROSS REFERENCE TO RELATED APPLICATIONS

I hereby claim benefit under Title 35, United States Code, Section 120 of U.S. patent application Ser. No. 13/083,781 filed Apr. 11, 2011. This application is a continuation-in-part of the Ser. No. 13/083,781 application. The Ser. No. 13/083,781 application is currently pending. The Ser. No. 13/083,781 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a garment hanger and more specifically it relates to a garment hanging system for safely hanging a long garment from a structure such as a door without the garment coming into contact with the floor or the surface of the door.

2. Description of the Related Art

Any discussion of the related art throughout the specification should in no way be considered as an admission that such related art is widely known or forms part of common general knowledge in the field.

Garment hangers have been used for years to safely store garments such as dresses, suits and the like in a manner which prevents wrinkling or damage. However, items such as wedding dresses or certain tuxedos are often considerably longer than other garments and thus come into contact with the floor when hung from conventional garment hangers.

To prevent such issues, longer garments such as wedding dresses are often put in garment bags. The garments bags are themselves hung from a garment hanger and tied off at their bottom ends to prevent the bottom of the garment from contacting the floor. However, by tying off the bottom of the garment bag, the longer garment will often become disheveled or wrinkled at its lower end due to being bunched up at the bottom of the garment bag.

Because of the inherent problems with the related art, there is a need for a new and improved garment hanging system for safely hanging a long garment from a structure such as a door without the garment coming into contact with the floor or the surface of the door.

BRIEF SUMMARY OF THE INVENTION

The invention generally relates to a garment hanging system which includes a bracket, a mounting portion extending from a first end of the bracket and an extension member extending from a second end of the bracket. The mounting portion extends downwardly from the bracket and includes a hook for holding a garment or accessory. The extension member extends upwardly and diagonally from the bracket such that any garment stored on a hook thereof will not contact the ground. An adjustment member may be positioned within the bracket to alter its effective width to match a wide range of doors.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
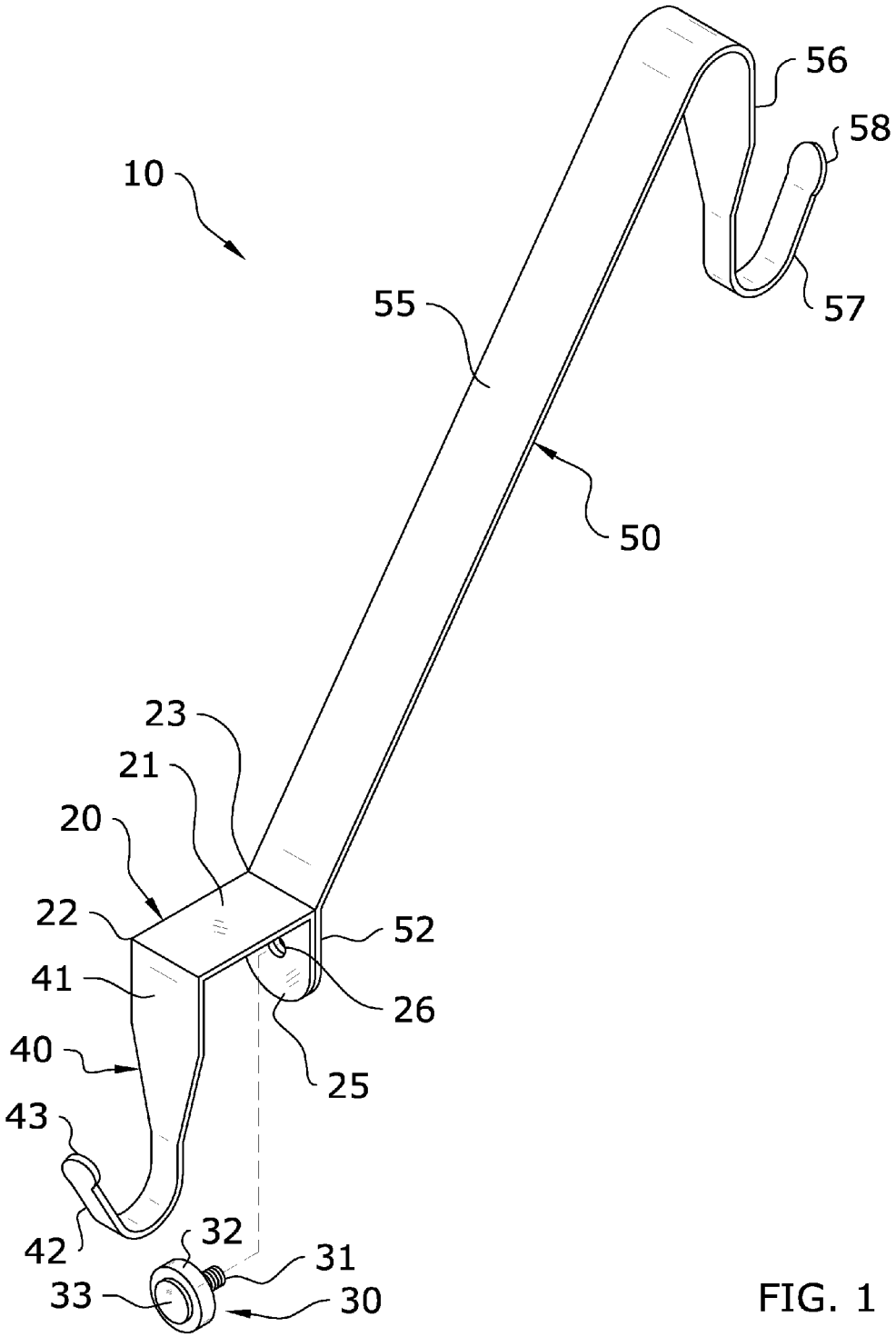
FIG. 1 is an upper perspective view of the present invention with the adjustment member removed.

Turning now descriptively to the drawings, in which similar reference characters denote similar elements throughout the several views, FIGS. 1 through 4 illustrate a garment hanging system 10, which comprises a bracket 20, a mounting portion 40 extending from a first end 22 of the bracket 20 and an extension member 50 extending from a second end 23 of the bracket 20. The mounting portion 40 extends downwardly from the bracket 20 and includes a hook 42 for holding a garment 18 or accessory. The extension member 50 extends upwardly and diagonally from the bracket 20 such that any garment 18 stored on a hook 57 thereof will not contact the ground. An adjustment member 30 may be positioned within the bracket 20 to alter its effective width to match a wide range of doors 12.

B. Bracket

The present invention includes a bracket 20 for mounting the present invention on the upper edge 14 of a door 12. The bracket 20 may be comprised of various configurations capable of being secured over the door 12 as shown in the figures. While the figures illustrate a specific bracket 20 design for exemplary purposes, it should be appreciated that various other shapes, sizes and designs of the bracket 20 may be utilized for different embodiments of the present invention. The scope of the present invention should not be construed as being limited by the exemplary figures.

In a preferred embodiment as shown in FIG. 1, the bracket 20 is comprised of a substantially inverted U-shaped member which fits over the upper edge 14 of a door 12. The bracket 20 generally include a flat upper portion 21 having a first end 22 and a second end 23. A connecting portion 25, adapted to be secured to a corresponding connecting portion 52 of the extension member 50, extends downwardly from the second end 23 of the upper portion 21.

The connecting portion 25 of the bracket 20 is comprised of a downward extension from the connecting portion's 25 second end 23 which includes an aperture 26. The aperture 26 is aligned with a corresponding aperture 53 on the extension member 50 such that the fastener 31 of the adjustment member 30 may pass through both. It is noted that the connecting portion 25 of the bracket 20 and the connecting portion 52 of the extension member 50 may be integrally formed, welded together, adhesively secured together or removably secured together depending on the embodiment of the present invention.

C. Mounting Portion

As shown in FIG. 1, a mounting portion 40 extends downwardly from the first end 22 of the bracket 20. The mounting portion 40 is adapted to hold a garment 18 or garment accessory. By way of example, if the hook 57 of the extension member 50 holds a wedding dress, the mounting portion 40 could hold a related shawl or veil.

Figure 2:
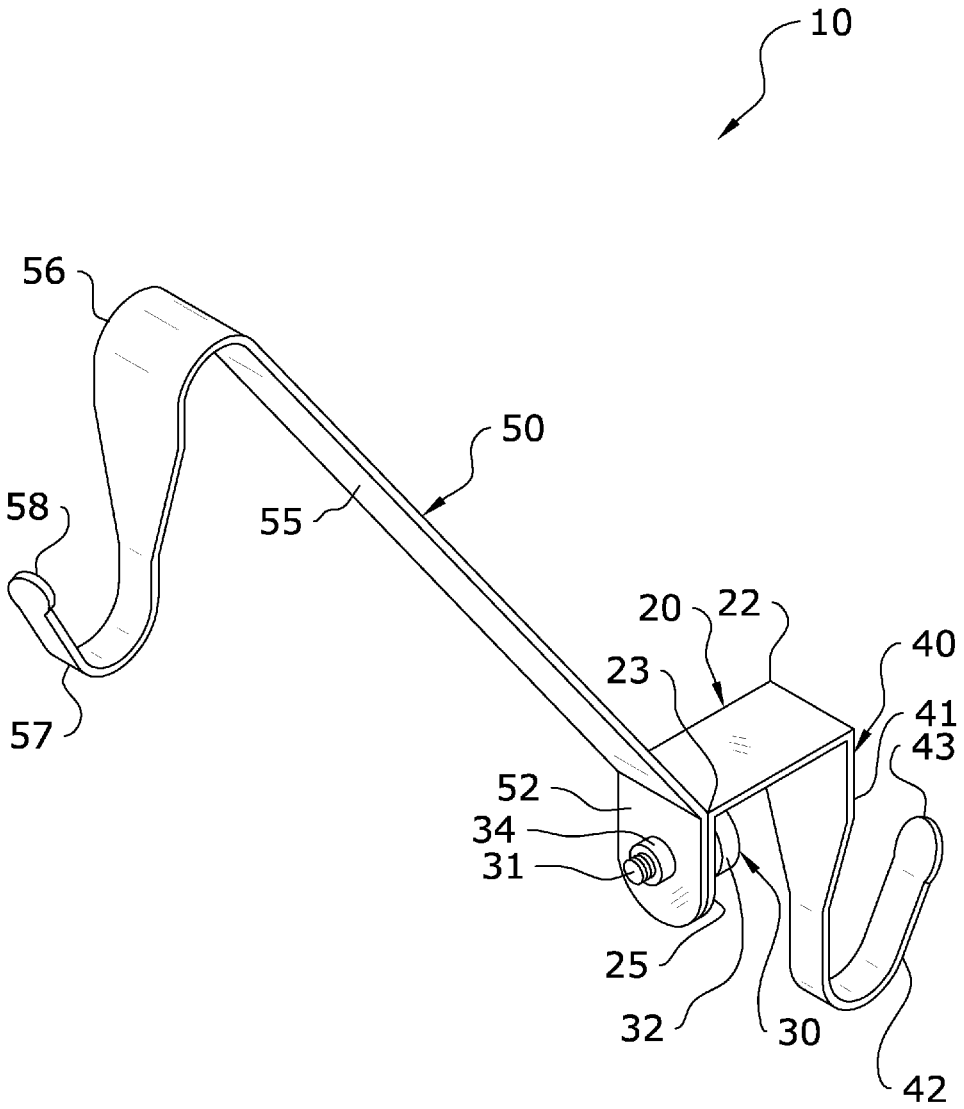
FIG. 2 is an upper perspective view of the present invention.

The mounting portion 40 is generally comprised of a vertical portion 41 which extends downwardly from the first end 22 of the bracket 20. The vertical portion 41 terminates into a hook 42 which is adapted to hold the garment 18 or garment accessory. Preferably, the width of the vertical portion 41 of the mounting portion 40 will taper inwardly before terminating into the hook 42 as shown in FIG. 2. The distal end 43 of the hook 42 may be rounded so as to aid in securing the garment 18 or garment accessory thereto.

D. Extension Member

Figure 4:
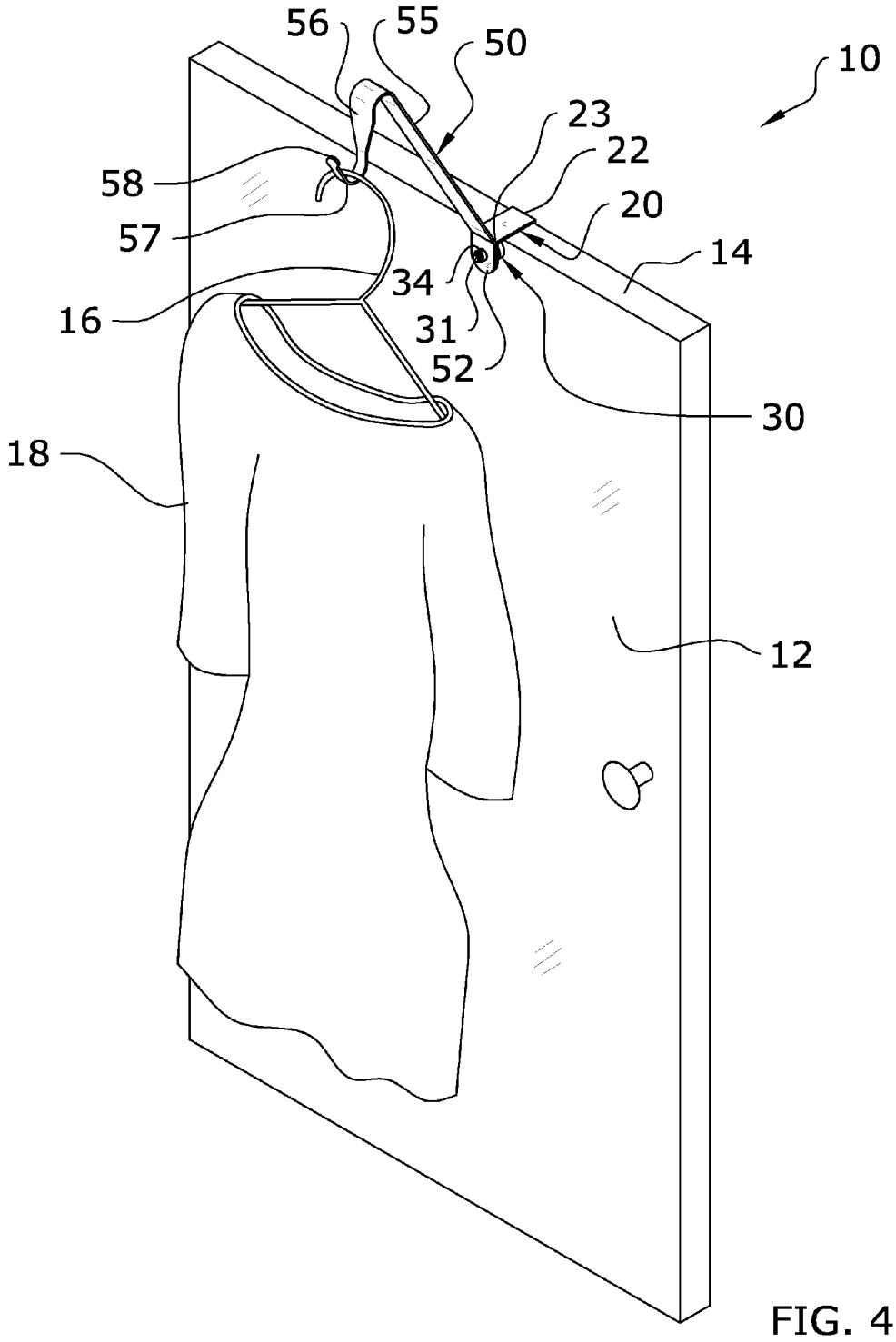
FIG. 4 is a frontal upper perspective view of the present invention in use as shown from a first side of a door.
Figure 5:
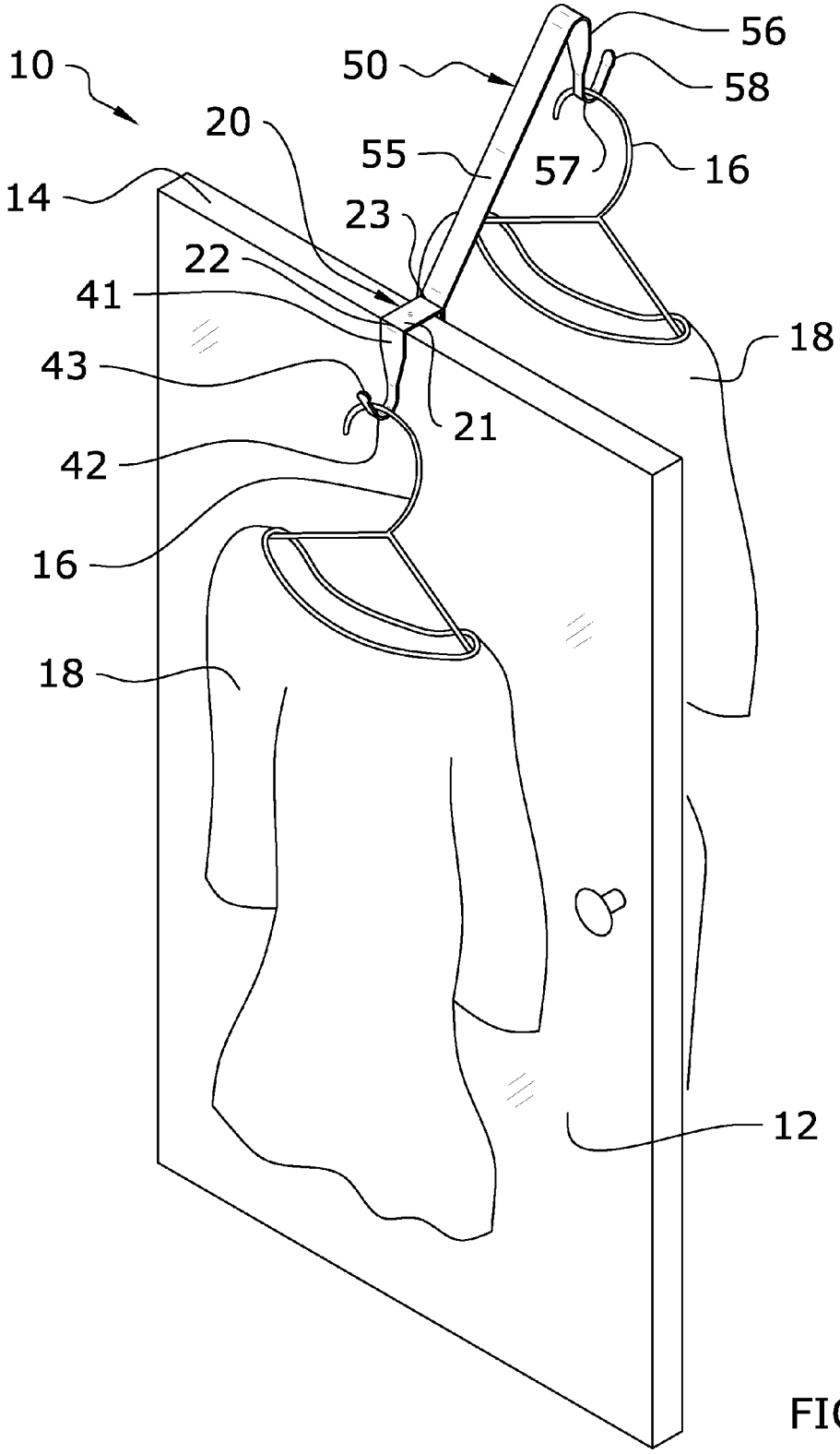
FIG. 5 is a rear upper perspective view of the present invention in use as shown from a second side of a door.

An extension member 50 preferably extends diagonally upward from the bracket 20 as shown in the figures. The extension member 50 extends to a vertical height above the upper edge 14 of the door 12 so as to ensure that the garment 18 being stored on the hook 57 thereof does not come in contact with the floor, such as shown in FIG. 4. The extension member 50 preferably also extends outwardly away from the outer surface of the door 12 so as to ensure that the garment 18 being stored on the hook 57 thereof does not come in contact with the door 12.

Figure 3:
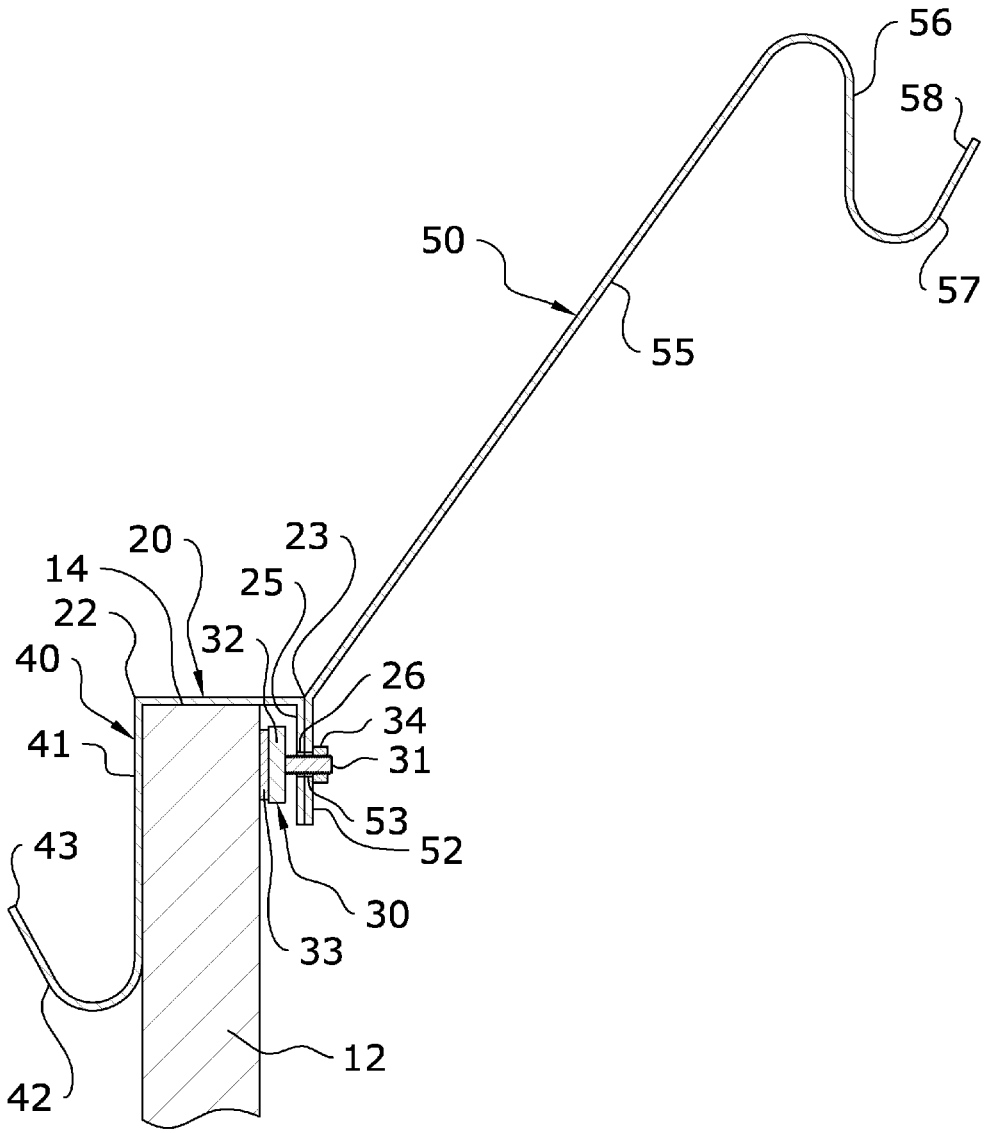
FIG. 3 is a side sectional view of the present invention installed on a door.

The extension member 50 includes a connecting portion 52 comprised of a vertical structure which is secured (such as by adhesive, welding or otherwise) to the corresponding connecting portion 25 of the bracket 20 as shown in FIG. 3. The connecting portion 52 includes an aperture 53 which is aligned with the corresponding aperture 26 of the bracket 20 to allow an adjustment member 30 to be secured thereto.

The extension member 50 includes a linkage portion 55 which extends diagonally upward from the connecting portion 52. Generally, the linkage portion 55 and connecting portion 52 will be integrally formed of a unitary structure. It is important that the linkage portion 55 extends diagonally upward so as to prevent the garment 18 from coming in contact with the floor beneath the door 12 on which the present invention is installed.

A vertical portion 56 extends downwardly from a distal end of the linkage portion 55 as shown in FIG. 3. The vertical portion 56 terminates into a hook 57 which is adapted to store a garment 18 such as a dress. Preferably, the width of the vertical portion 56 of the extension member 50 will taper inwardly before terminating into the hook 57 as shown in FIG. 2. The distal end 58 of the hook 57 may be rounded so as to aid in securing the garment 18 or garment accessory thereto.

E. Adjustment Member

The present invention preferably includes an adjustment member 30 so as to adapt to doors 12 of varying widths. The adjustment member 30 may be comprised of various structures, but will preferably be comprised of a rounded base member 32 and a threaded fastener 31 extending therefrom. Padding 33 may be included on the outer edge of the base member 32 so as to prevent damage to the door 12 when the present invention is in use.

The adjustment member 30 is secured to the connecting portion 25 of the bracket 20 facing toward the mounting portion 40 as shown in FIG. 1. The threaded fastener 31 extends through the apertures 26, 53 and is secured therein with a nut 34. Using the fastener 31 and nut 34, the depth to which the adjustment member 30 extends into the bracket 20 may be varied. FIG. 3 illustrates the adjustment member 30 in use to lessen the effective width of the bracket 20 to fit a narrower door 12.

F. Operation of Preferred Embodiment

In use, the present invention will be installed on a door 12 or other structure by positioning the bracket 20 around the upper edge 14 thereof. If the door 12 or other structure is too narrow, the bracket's 20 effective width may be narrowed by adjusting the adjustment member 30 accordingly. With the bracket 20 securely attached to the door 12 or other structure, garments 18, hangers and the like may be hung from the hooks 42, 57. The structure of the extension member 50, which extends up and out from the top portion of the door 12, will prevent even long garments 18 such as wedding dresses from contacting the floor.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A garment hanging system, comprising:

a bracket adapted to be secured to an upper edge of a door;

a mounting portion extending downwardly from a first end of said bracket, wherein said mounting portion includes a first vertical portion extending downwardly from said first end of said bracket;

a first hook extending from a distal end of said first vertical portion; and an extension member comprising a linkage portion extending diagonally and upwardly from a second end of said bracket, wherein said linkage portion includes a second vertical portion extending downwardly from a distal end of said linkage portion; and a second hook extending from a distal end of said second vertical portion for retaining a garment away from said door and above a floor surface.

2. The garment hanging system of claim 1, wherein said bracket, said mounting portion and said extension member are integrally formed of a unitary structure.

3. The garment hanging system of claim 1, further comprising an adjustment member adapted to be secured within said bracket for varying an effective width thereof.

4. The garment hanging system of claim 1, wherein said first vertical portion is inwardly tapered.

5. The garment hanging system of claim 1, wherein said first hook includes a rounded distal end.

6. The garment hanging system of claim 1, wherein said first vertical portion is inwardly tapered.

7. The garment hanging system of claim 1, wherein said first hook includes a rounded distal end.

8. A garment hanging system, comprising:

a bracket adapted to be secured to an upper edge of a door;

a mounting portion extending downwardly from a first end of said bracket, wherein said mounting portion is comprised of a first vertical portion and a first hook at a distal end of said vertical portion;

an extension member extending diagonally upward from a second end of said bracket, wherein said extension member is comprised of a linkage portion extending diagonally upward from said bracket, a second vertical portion extending vertically downward from said linkage portion and a second hook positioned at a distal end of said second vertical portion, wherein said extension member is connected to said bracket by a fastener; and a garment retained on said second hook such that said garment is positioned away from said door and above said door such that no portion of said garment contacts a floor surface.

9. The garment hanging system of claim 8, wherein said bracket includes a first connecting portion, wherein said first connecting portion includes a first aperture.

10. The garment hanging system of claim 9, wherein said extension member includes a second connecting portion, wherein said second connecting portion includes a second aperture.

11. The garment hanging system of claim 10, wherein said first aperture is aligned with said second aperture.

12. The garment hanging system of claim 11, further comprising an adjustment member for varying the effective width of said bracket.

13. The garment hanging system of claim 12, wherein said adjustment member is comprised of a base member, a threaded fastener extending from said base member and a padding positioned on said base member.

14. The garment hanging system of claim 13, wherein said threaded fastener extends through said first aperture and said second aperture and further comprising a nut for securing said fastener therein.

* * * * *